US007717869B2

(12) United States Patent
Eischen, Sr.

(10) Patent No.: US 7,717,869 B2
(45) Date of Patent: May 18, 2010

(54) PRESSURE MAINTAINED INFLATABLE BOOT

(75) Inventor: Clement G. Eischen, Sr., Gresham, OR (US)

(73) Assignee: Eischco, Inc., Oceanside, OR (US)

( * ) Notice: Subject to any disclaimer, the term of this patent is extended or adjusted under 35 U.S.C. 154(b) by 579 days.

(21) Appl. No.: 11/060,933

(22) Filed: Feb. 18, 2005

(65) Prior Publication Data

US 2006/0189905 A1 Aug. 24, 2006

(51) Int. Cl.
*A61H 7/00* (2006.01)

(52) U.S. Cl. ..... 601/152; 602/13

(58) Field of Classification Search ..... 601/148–152; 602/13; 128/DIG. 20
See application file for complete search history.

(56) References Cited

U.S. PATENT DOCUMENTS 1,257,086 A 2/1918 Marcellus
2,531,074 A 11/1950 Miller
2,694,395 A 11/1954 Brown
3,083,708 A 4/1963 Gottfried
3,351,055 A 11/1967 Gottfried
3,403,673 A 10/1968 MacLeod
3,469,576 A 9/1969 Smith et al.
3,548,809 A 12/1970 Conti
3,824,992 A 7/1974 Nicholson et al.
3,888,242 A 6/1975 Harris et al.
4,067,063 A 1/1978 Ettinger
4,128,951 A 12/1978 Tansill
4,166,460 A 9/1979 Applegate
4,227,320 A 10/1980 Borgeas
4,263,905 A 4/1981 Couch
4,266,298 A 5/1981 Graziano
4,370,975 A 2/1983 Wright
4,502,470 A 3/1985 Kiser et al.
4,575,097 A 3/1986 Brannigan et al.
4,628,932 A 12/1986 Tampa
4,722,332 A 2/1988 Saggers
4,805,601 A 2/1989 Eischen
4,805,620 A 2/1989 Meistrell
4,845,338 A * 7/1989 Lakic ..... 219/211
4,922,893 A 5/1990 Wright et al.
4,947,834 A 8/1990 Kartheus et al.
4,977,891 A 12/1990 Grim
4,995,173 A * 2/1991 Spier ..... 36/29
5,000,176 A 3/1991 Daniel
5,025,575 A * 6/1991 Lakic ..... 36/44
5,113,599 A 5/1992 Cohen et al.
5,133,348 A 7/1992 Mayn
5,148,804 A 9/1992 Hill et al.
5,230,335 A 7/1993 Johnson et al.

(Continued)

FOREIGN PATENT DOCUMENTS

CA 960537 1/1975

(Continued)

*Primary Examiner*—Michael A. Brown
(74) *Attorney, Agent, or Firm*—Kolisch Hartwell, P.C.

(57) ABSTRACT

An inflatable boot used for treating lower extremity injuries. The boot may encase at least a portion of a lower extremity, and may include a bladder defined by a substantially gas impermeable cover and liner. The bladder may include fluidically interconnected sole and leg portions. Additionally the boot may include a pump is configured to draw air into the bladder upon ambulatory motion, and a pressure release valve adapted to limit the pressure within the bladder.

10 Claims, 4 Drawing Sheets

U.S. PATENT DOCUMENTS

| | | | | |
|---|---|---|---|---|
| 5,343,638 | A | 9/1994 | Legassie | |
| 5,348,530 | A | 9/1994 | Grim et al. | |
| 5,350,418 | A | 9/1994 | Janevski et al. | |
| 5,376,130 | A | 12/1994 | Courtney | |
| 5,409,500 | A | 4/1995 | Dyrek | |
| 5,415,624 | A | 5/1995 | Williams | |
| 5,435,009 | A | 7/1995 | Schild et al. | |
| 5,496,357 | A | 3/1996 | Jensen et al. | |
| 5,496,358 | A | 3/1996 | Rosenwald | |
| 5,676,639 | A * | 10/1997 | Schild | 601/151 |
| 5,697,962 | A | 12/1997 | Brink et al. | |
| 5,728,058 | A | 3/1998 | Ouellette et al. | |
| 5,868,690 | A * | 2/1999 | Eischen, Sr. | 601/151 |
| 6,048,326 | A | 4/2000 | Davis et al. | |
| 6,189,172 | B1 * | 2/2001 | Baek | 12/142 P |
| 6,235,049 | B1 | 5/2001 | Nazerian | |
| 6,352,550 | B1 | 3/2002 | Gildersleeve et al. | |

FOREIGN PATENT DOCUMENTS

| | | |
|---|---|---|
| DE | 27 37 734 A1 | 12/1978 |
| EP | 0039629 | 4/1981 |
| GB | 1171361 | 11/1969 |
| RU | 260822 | 5/1970 |
| RU | 574213 | 10/1977 |

* cited by examiner

PRESSURE MAINTAINED INFLATABLE BOOT

FIELD OF THE INVENTION

This invention relates to an inflatable boot, and more particularly to an inflatable boot used in the treatment of a human lower extremity.

BACKGROUND OF THE INVENTION

Inflatable boots have been employed in the rehabilitation of injured lower extremities for several years. In recent years, therapeutic inflatable boots which include a massaging feature have been developed. Two such massaging therapeutic boots are disclosed in U.S. Pat. Nos. 4,805,601, and 5,868,690, the complete disclosures of which are incorporated herein by reference for all purposes.

In these inflatable boots, air moves between a first fluid chamber, located on the sole of the inflatable boot, and two or more fluidically connected chambers dimensioned to surround the injured area. When a user pushes down on the first fluid chamber, while walking or pushing against a solid surface, compression of the first chamber moves air or fluid into the fluidically connected chambers and thus, causes a pressure increase in the connected chambers. Such pressure increase is maintained until the user releases the first fluid chamber to its expanded, pre-compressed configuration by lifting the sole during the walking stride or by relaxing the applied force against a stationary surface. Thus, these inflatable boots function to providing recurrent compression, or increased pressure, to an injured area by varying the fluid pressure imparted by the first chamber onto the fluidically connected chambers.

Recurrent compression of these inflated chambers creates a variation of pressures, or massaging, upon the injured lower extremity encased within the inflatable boot, and results in improved blood flow to the injured area. Efficient blood flow through the lower extremity is partially dependent upon the contraction of muscles. When a foot or ankle is injured, muscle contractions are often limited because it is painful and/or harmful to put weight on the extremity. The massaging action of the therapeutic inflatable boots improves blood flow by mimicking the pumping effect of muscle contractions in forcing pooled blood out of the veins. Such an improved blood flow promotes healing by taking away damaged cell waste products and providing a steady supply of cellular nutrients.

A massaging pressure variation may only promote blood flow if the pressure within the therapeutic boot is maintained within a certain therapeutic range. If the pressure in the inflatable boot is too low, the compression of the first chamber may not result in an increased pressure in the fluidically connected chambers that is sufficient to apply an external therapeutic pressure onto the encased injured extremity. If the boot-provided external pressure is too high, optimized healing may be inhibited. Conventional therapeutic inflatable boots are incapable of insuring that a proper therapeutic range of pressures is maintained at all times and under all atmospheric conditions.

SUMMARY OF THE INVENTION

An inflatable boot used in the rehabilitation of lower extremities is disclosed in the present application. The boot includes a bladder for encasing at least a portion of a lower leg, an ankle, and a foot. The bladder may be defined by an inner and an outer layer of substantially gas impermeable material, and may include at least one wall portion and a sole portion. The at least one wall portion and the sole portion may be fluidically interconnected.

The boot additionally includes a pressure control system, consisting of a pump and a pressure release valve. The pump is configured to draw air into the bladder upon ambulatory motion. The pressure release valve is adapted to limit the pressure within the bladder, such that the pressure may not exceed a maximum therapeutic pressure.

DETAILED DESCRIPTION OF THE INVENTION

Figure 1:
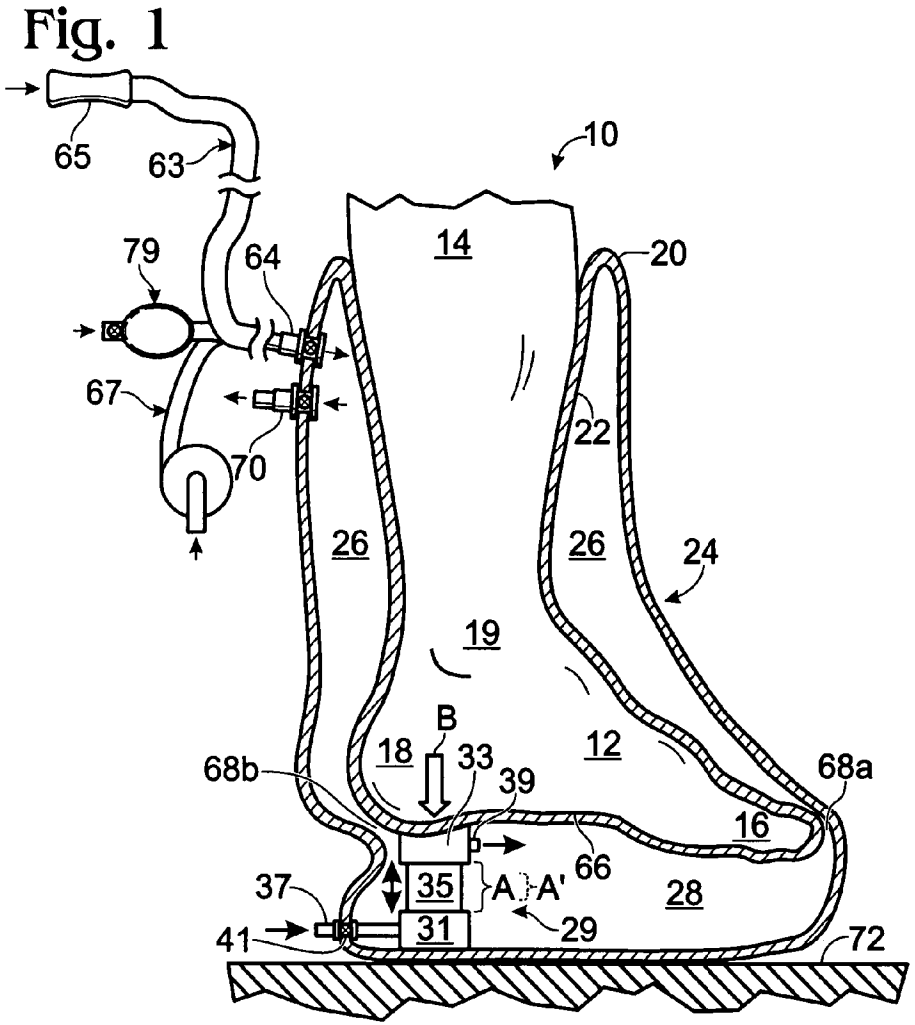
FIG. 1 is an isometric view of a boot having a pump located within the bladder according to the present disclosure.

In FIG. 1, a boot is identified generally with the numeral 10. Boot 10 is intended to encase a portion of a human lower extremity. Boot 10 may be specifically designed to treat lower extremity injury or disease and be utilized to promote healing of one or more portions of the lower extremity encased within the boot. Boot 10 may encase all or a portion of a lower leg 14, an ankle 19, and a foot 12, including heel 18, and toes 16. Alternatively, boot 10 may include openings to expose portions of the lower extremity, such as the heel, toes, or other region of the extremity not requiring treatment.

Boot 10 may include a cover or outer layer 20 joined, or sealed, to a liner or inner layer 22. Cover 20 and liner 22 may each be constructed from flexible material that is completely, or substantially, gas impermeable, or air-tight. In addition to being flexible and gas impermeable, the material of cover 20 and liner 22 may be durable, easily sealed, and generally non-irritating to an inserted human foot. Such flexible gas impermeable materials may include coated nylon cloth, coated canvas, ether-based polyurethane, rubbers, plastics, or other suitable materials. Cover 20 and liner 22 may be formed, or constructed from the same material, or from two or more different materials. For example, cover 20 may be constructed of coated 200 denier nylon oxford, and liner 22 may be constructed of ether-based polyurethane. Cover 20 and liner 22 may be constructed out of a single, contiguous sheet of such suitable material so as to avoid piecing, seams, and seals and to preserve the air impermeability throughout, or alternatively, may be pieced together using one or more pieces of material.

Cover 20 and liner 22 may collectively define a bladder 24 of boot 10. Bladder 24 may be contiguous throughout boot 10, such that a pressure change within any portion of bladder 24 may be communicated to the remaining portions of bladder 24. Portions of bladder 24 may be fluidically connected to allow contiguous fluid or pressure communication throughout the bladder 24 of boot 10.

In some embodiments of boot 10, bladder 24 may have a number of fluidically connected portions, including a leg portion, indicated generally at 26, and a sole portion, indicated generally at 28. The bladder leg portion 26 may be sized and shaped for encasing at least a portion of lower leg 14, and the bladder sole portion 28, may be sized and shaped for encasing at least a portion of the foot 12. Accordingly, the bladder leg portion 26 may encase, or wrap around one or more sides of the leg and ankle, and the bladder sole portion may wrap around one or more sides of the foot, including the sole 66. In some embodiments, the bladder sole portion 28 may be adapted to be disposed beneath the sole 66 without wrapping one or more sides of the foot.

Bladder leg portion 26 and bladder sole portion 28 may be fluidically connected to each other via passageways including 68*a* and 68*b*. A passageway, indicated generally as 68, may be any open-flow connection between one or more bladder portions. Such passageways may be general flow areas between portions of a contiguous bladder 24 or alternatively, passageways 68 may be sealed partitions, columns or openings permitting flow between two distinct bladder portions. Air, or other fluid, may move in either direction in passageways 68, in order to maintain an equalized pressure throughout all portions of bladder 24.

A pump 29 may be located within one or more bladder portions. Pump 29 may include a first member 31, a second member 33, a reciprocating compression body 35, a pump intake system 37, and a pump outflow system 39. Air, or other fluid, may be contained within pump 29 in one or more locations, including the body, air intake system, or the air outflow system.

The pump intake system 37 and/or pump outflow system 39 may include a one-way check valve 41 to assist in moving air from the exterior of the boot into bladder 24. One-way valve 41 may function to prevent, or substantially limit, any movement of air out of the bladder to the boot exterior through the pump 29. Accordingly, exterior air may be taken into pump 29 through the pump intake system 37, and moved through the pump in only one direction, moving external air, or air from the boot's exterior, into the bladder 24.

When in a neutral position, the first pump member 31 and the second pump member 33 may be separated by body 35. As shown in FIG. 1, first and second pump member 31, 33 may be separated by a distance A. When a force is applied to pump 29 in the direction of arrow B, the first pump member 31 and the second pump members 33 may move closer together, which may compress body 35. In such a compressed position, the first pump member 31 and the second pump member 33 may be separated by a distance A'.

When the compressing force applied in the direction of arrow B is removed, pump 29 may return to a neutral position. During a return to the neutral position of pump 29, a negative pressure may be created within the pump which may draw external air into the pump through the pump intake 37. Subsequent compression of pump 29 may expel air from the pump through pump outflow system 39 and into bladder 24. The amount of negative pressure created in pump 29 may, in part, determine the volume of air that is moved into the bladder 24 by pump 29. The design and size of the pump, as well as the amount of force applied by the user, may also affect the volume of air that is moved into the bladder 24 by pump 29.

It should be appreciated that while FIG. 1 shows pump 29 located in the bladder sole portion directly below the foot heel 18, alternative embodiments may include a pump in the sole portion directly below any other aspect of the foot including the toes 16, ball of foot 17, and/or may include a pump located within the bladder leg portion. While pump 29 is schematically shown as a two part cylinder-shaped pump, it should be appreciated that pump 29 may be configured in any shape, including a wedge, an elongated platform, a circle, or a block. Further, pump 29 may occupy all, or any portion of, the bladder sole portion.

Additionally, schematically shown pump 29 may be any type of pump capable of drawing air into the bladder. While FIG. 1 shows a compression pump, alternative embodiments may include cylinder and piston pumps, rubber bulb pumps, encased sponge pumps, and or multipart resin pumps. Regardless of the type of pump utilized, pump 29 may be constructed from lightweight materials, such as aluminum, titanium, or resins in order to maintain a low overall weight of boot 10.

Pump 29 may also be disposed exterior to bladder 24 but in fluid communication therewith. For example, in some embodiments boot 10 may include an outsole or tread disposed between the cover of boot 10 and the ground surface. In these embodiments, pump 29 may be disposed between the cover and the outsole. Pump 29 may be disposed in operative association with bladder 24 such that external air can be pumped into bladder 24. In some embodiments pump 29 may be disposed such that the pump is compressed with each step of the user, for users that are able to walk. In other embodiments, pump 29 may be configured to be repeatedly compressed through alternative user interaction.

Pump 29 may be utilized to inflate bladder 24. When pump 29 is located within the bladder sole portion 28, air exiting the pump may enter the sole portion 28. Because the sole portion 28 may be in fluid connection with the remainder of bladder 24, including the leg portion 26, this air may flow out of sole portion 28 and into other bladder portions so that air pressure is equal in all connected bladder portions. Air may flow out of the sole bladder portion to the leg bladder portions via passageways 68. Repetitive compressions of pump 29 may be required to inflate the bladder to the desired air volume.

Alternative means of inflating bladder 24 may also be utilized. Boot 10 may include an inlet valve 64 which may serve as an alternative location for the intake of air, or fluid, into bladder 24. Inlet valve 64 may be adapted to selectively couple with various inflation devices, including inflation tubing 63, mouthpiece 65, hand pump 79, or other auxiliary mechanical or electrical pumps 67.

A user may utilize any of such inflation devices to manually inflate bladder 24. A boot user may blow up, or inflate, bladder 24 of boot 10 by blowing air into inflation tubing 63 at mouth piece 65. Thus, the user may blow through the inflation tubing, through inlet valve 64, and into bladder 24. The inflation tubing may be elongated so as to allow a user to blow into mouth piece 65 at a level above the boot 10.

A user may also pump-up, or inflate, bladder 24 using hand pump 79. A user may compress and release the bulb of hand pump 79 to create a negative pressure within the hand pump 67, which may draw air into hand pump intake, through inlet valve 64, and into bladder 24. Thus, bladder 24 of boot 10 may be inflated using one or more mechanisms, including a pump 29 located within the bladder, inflation tubing 63, mouthpiece 65, hand pump 79, or other auxiliary electrical or mechanical pumps, illustrated generally at 67.

Once inflated, bladder 24 may protect the extremity by maintaining a space, or cushion, of pressurized air around the lower extremity. This inflated bladder 24 may provide some degree of protection in the event the encased lower extremity collides with, or bumps against, external objects. In some embodiments, the inflated bladder may conform to at least some portions of the lower extremity. By conforming to the lower extremity, inflatable boot 10 may also protect open wounds on the lower extremity from dirt and/or germs.

Pumping external air into bladder 24 may transition boot 10 from a deflated, storage configuration into an inflated operating configuration. The operating configuration of boot 10 may partially immobilize the encased lower extremity including the ankle joints and toe joints. This immobilization may be therapeutically advantageous in the treatment of some lower extremity injuries, including torn or surgically reconstructed tendons or ligaments, muscle tears, and ankle or foot sprains. Additionally, the inflated, operating configuration of boot 10 may provide compression to an injured lower extremity, which may decrease swelling in the injured lower extremity.

With continued reference to FIG. 1, some embodiments of boot 10 may include a pressure release valve 70. Pressure release valve 70 may permit air to exit bladder 24 when the pressure within the bladder exceeds a maximum therapeutic pressure. A maximum therapeutic pressure may be a pressure above that which a clinical practitioner deems to be therapeutically beneficial.

The maximum predetermined therapeutic pressure may vary depending on the user and the type of lower extremity injury or disease being treated with the application of boot 10. The maximum therapeutic pressure may be as high as 100 mm Hg, or approximately 2 psi. In some applications of inflatable boot 10, the maximum therapeutic pressure may be higher than 100 mm Hg. A clinician may select a maximum therapeutic pressure to be a pressure ranging from about 25 mm Hg to about 125 mm Hg, such as 40, 50, 60, 75, 90, 100, or 110 mm Hg, or any other pressure in the range.

Boot 10 may be provided with a clinician-selectable maximum therapeutic pressure in a number of ways. For example, boot 10 may be provided in a plurality of configurations or sizes, each size being equipped with a pressure release valve of a different maximum therapeutic pressure. Alternatively, boot 10 may be provided with pressure release valve having an adjustable release pressure such that the clinician can modify the pressure release valve to release at air at the maximum therapeutic pressure. Some embodiments may include features to allow the clinician to adjust the pressure release valve while preventing the user from later modifying the release pressure.

Pressure release valve 70 may prevent a user from inflating bladder 24 beyond a predetermined maximum therapeutic pressure. Without such a pressure control, a user may, intentionally or unintentionally, inflate boot 10 beyond the maximum therapeutic pressure for a variety of reasons. For example, a user may unintentionally over-inflate bladder 24 because it may be difficult to determine the pressure during inflation. Alternatively, a user may find that inflation beyond the maximum therapeutic pressure feels more comfortable to the user because the increased pressure may reduce blood flow to the nerves, which may decrease pain sensation. Additionally, atmospheric changes, such as changing elevations or changing ambient temperatures, may result in an increased pressure within bladder 24 of boot 10. Pressure release valve 70 thus prevents elevated bladder pressures that may exceed a maximum therapeutic pressure.

Figure 2:
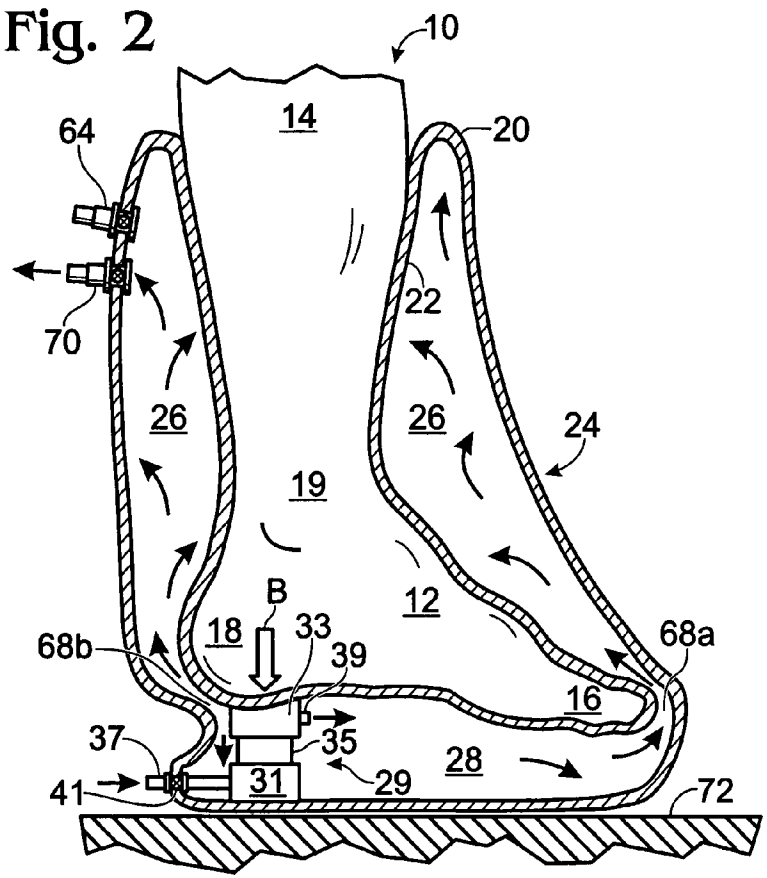
FIG. 2 is an isometric view of the boot of FIG. 1 inflated and compressed.

Pressure release valve 70 and intake valve 64 are illustrated as separate valves in FIGS. 1 and 2. Boot 10 may also omit intake valve 64 relying on the internal pump for inflation of the bladder. Alternatively, intake valve 64 and pressure release valve 70 may be integrated into a single valve assembly.

Pump 29 and pressure release valve 70 may function together to maintain a proper therapeutic pressure within the bladder, thus acting as a pressure maintenance system. The pressure maintenance system may operate to maintain the pressure in the boot within a predetermined therapeutic pressure range. The minimum therapeutic pressure on the lower extremity may be between 20 mm Hg and 60 mm Hg. When combined with the maximum therapeutic pressure, the therapeutic pressure range may fall somewhere between 20 mm Hg and 125 mm Hg depending on the type of lower extremity injury or disease being treated with the boot.

While the pressure release valve 70 may insure that a maximum therapeutic pressure is not exceeded, pump 29 may insure that a minimum therapeutic air pressure is maintained within bladder 24. Pressure may drop within the bladder over time for a number of reasons. For example, air may slowly escape from the bladder through seams, seals, or through the cover or liner material. Additionally, the internal pressure may change for the same atmospheric reasons discussed above for pressure increases. A boot that is inflated in a warm environment may provide much less pressure when worn in a cold environment.

As discussed above, pump 29 may be configured to draw air into bladder 24. Depending on the location of pump 29, pump activation may occur during ambulatory motion when a user steps, walks, or runs or while a user pushes the pump against a solid surface. If the air drawn into bladder 24 by pump 29 causes the pressure inside bladder 24 to exceed the predetermined maximum therapeutic pressure, air may exit bladder 24 out of the pressure release valve 70 in order to decrease the bladder pressure to be within the therapeutic range. Thus, the therapeutic range may be maintained within bladder 24 by continuous inflation of pump 29 held in check, or controlled, with the pressure limiting effect of pressure release valve 70.

FIG. 2 illustrates the compression of boot 10 which may occur during ambulation. While compression during ambulation is illustrated, boot 10 may be compressed through other methods of applying pressure on the boot, such as a user pressing the sole of his foot towards a wall or by automated mechanical means. During ambulation, boot 10 may be pressed against a surface 72 with a downward force in the general direction of arrow B. In addition to compressing pump 29, as discussed above, such a downward force may cause bladder sole portion 28 to be pressed against, and compressed by, surface 72. When sole portion 28 is pressed against surface 72, the flexible material of cover 20 and liner 22 surrounding sole portion 28 may be deformed so as to compress or slightly flatten sole portion 28.

Upon such compression, the volume of sole portion 28 may be significantly reduced increasing the air pressure within the sole portion. As sole portion 28 may be contiguously connected to other portions of bladder 24 by passageways 68, the increased pressure in sole portion 28 may cause air to move out of compressed sole portion 28 and into leg portion 26 in order to achieve an equalized pressure throughout bladder 24. The equalized bladder pressure is higher than the bladder pressure that existed when boot 10 was in the neutral state shown in FIG. 1. It should be noted that while FIG. 2 illustrates a boot with a compressed sole portion, compression of any portion of bladder 24 may result in pressure increase throughout the boot.

In this compressed state, boot 10 may exert an increased pressure on the encased lower extremity. This increased pressure may move blood out of the venous system of the injured area, so as to improve blood flow. It may be appreciated that as the pressure is equalized in all parts of bladder 24, boot 10 exerts approximately equal amounts of pressure throughout the encased portions of the lower extremity. Thus, any pressure increase may be distributed throughout the entire encased lower extremity, including leg 14, ankle 19, and foot 12.

Once the compressive force is removed, sole portion 28 may return to a neutral state and the bladder pressure may return to an original, non-compressed pressure. When sole portion 28 returns to the non-compressed neutral state illustrated in FIG. 1, the relative pressure in sole portion 28 decreases, and air flows into sole portion 28 via passageways 68 to again equalize the pressure throughout bladder 24. The recurrent or repetitive compression of boot 10 may cause recurrent pressure variation, or massaging of the injured encased lower extremity. Such massaging may increase the blood flow to this area and may promote healing.

The amount of pressure elevation that occurs upon any compression of boot 10 may be dependent upon a number of factors, including the relative volumes of air contained within the respective bladder portions, the compressibility of the bladder, and the amount of compressive force applied. Compression of a large volume of sole portion may cause a correspondingly larger volume of air to be moved out of the sole portion and into leg portion 26 in order in equalize the pressure throughout bladder 24. The flexibility of the materials used to construct cover 20 and liner 22 may contribute to the compressibility of the boot 10, and thus to the compressibility of sole bladder 28.

Depending on a number of factors, including the relative volumes of the sole and leg portions, the materials of the bladder, and the compressive force applied, the increase of pressure during boot compression may vary. For example, the bladder pressure, and thus, the pressure exerted by the boot onto the encased lower extremity, may increase from 40 mm Hg to 90 mm Hg. Alternatively, other boots may increase from 50 mm Hg to 60 mm Hg. The degree of pressure change may be customized to provide the user with a desired therapeutic massaging effect. For example, some injuries treated by the inflatable boot may require large pressure differences to provide a deep massaging effect. Alternatively, a surface wound may require only gentle massaging for which a very minor pressure change may be preferred. As described above, pressure check valve 70 and pump 29 may be configured to maintain the pump in a desired therapeutic pressure range, including providing a desired therapeutic massaging effect.

Figures 3, 4, 5, 6:
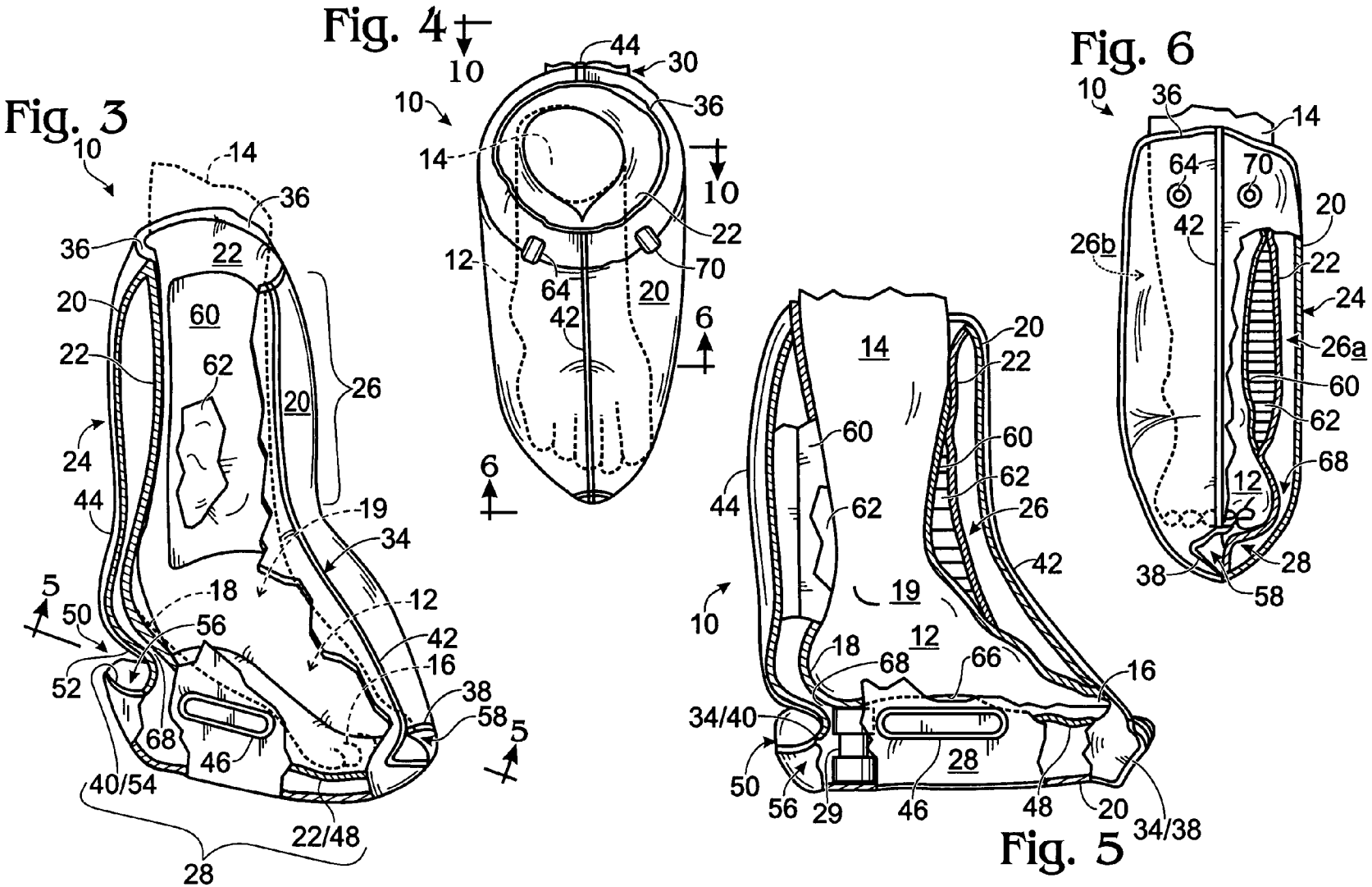
FIG. 3 is a cut-away perspective view of a boot having a structural interconnection of noninflation according to the present disclosure.
FIG. 4 is a plan view of the top of the boot shown in FIG. 3.
FIG. 5 is a cross-sectional view of the boot shown in FIG. 3 along line 5-5.
FIG. 6 is a cut-away frontal view of the boot shown in FIG. 4, cut-away generally along line 6-6 of FIG. 4.

With reference to FIG. 3, inflatable boot 10 is illustrated with a plurality of seals and seams which may function to maintain boot 10 in a desired configuration. As used herein, a seal is the joining of boot cover 20 to liner 22 to define bladder 24, and a seam is the joining of two portions of bladder 24 to define a boot. Seals and seams may also be directly interconnected, and thus, may be united at some junctions.

A bladder seal 34 may be along the circumference of the entire, or substantially the entire bladder 24. Several segments of bladder seal 34 are illustrated in FIG. 3, including a pair of top seals 36, a toe seal 38, and a heel seal 40. In its entirety, bladder seal 34 may function to substantially maintain inflated air inside bladder 24 formed between gas impermeable cover 20 and liner 22. Boot 10 may also include a structural interconnection seal 46 that is isolated from bladder seal 34, and may function to form a structural support as described in further detail below.

Boot 10 may include one or more seams including a front seam 42, and a rear seam 44. The front seam and the rear seam may be the joining of two portions of bladder seal 34 into proper orientation to form a boot 10. The seams may hold boot 10 in a lower extremity encasing boot shape.

Seals and seams may be made by a variety of methods, including heat sealing, radio frequency sealing, stitching, etc. More than one method may be used in the construction of each boot 10. All of the seals may be formed before any of the seams are formed in some boot constructions. Furthermore, it may be possible to form some seams concurrently with the seals, so that in essence, the seals and the seams may overlap, or fuse in those portions of the bladder. While multiple seals and seams are illustrated in FIG. 3, it may be appreciated that alternative embodiments may be constructed without the use of any seams. Such alternative embodiments may be constructed from a single piece of material, be constructed from extruded material, or may be molded, for example.

As discussed above, boot 10 may include one or more structural interconnection seals 46 which may be substantially separate, or isolated, from bladder seal 34. A structural interconnection seal 46 may join or interconnect cover 20 directly to liner 22 at a location that is interior to the bladder seal 34, and thus, is interior to any edge of the boot cover or liner. The structural interconnection seal may be located interposed sole bladder portion 28 and leg bladder portion 26, intermediate front seam 42 and rear seam 44, and independent of bladder seal 34. A first structural interconnection seal 46 may be formed on the right side of boot 10, and a second structural interconnection seal may be formed on the left side of boot 10 (not shown).

As the structural interconnection seal 46 may be isolated from bladder edge 34, any area within the interconnection seal 46 may not get inflated when bladder 24 is inflated. These uninflatable areas may function to provide support to the encased lower extremity. As shown in FIG. 3, by joining cover 20 and liner 22 in a region within the interior of bladder 24 between leg portion 26 and sole portion 28, structural interconnection 46 may create a foot-supporting contour for sole portion 28 of bladder 24 by causing a fluid-filled inflated cushion to form under foot 12 when bladder 24 is inflated. Thus, liner 22 within sole portion 28 may form a platform 48 for the foot when bladder 24 is inflated.

The geometrical configuration of the structural interconnection seal 46 used may vary depending on the choice of materials used, the desired ornamental appearance, and the desired level of support desired. The elongated oval structural interconnection seal 46 illustrated in FIG. 3 may provide a joining of cover 20 to liner 22 that is of sufficient strength to prevent material failure or delamination. However, other geometrical configurations may be used. For example, a series of isolated structural interconnection seals in a row, or simply a liner seal may be used, in alternative embodiments.

Still referring to FIG. 3, the formation of platform 48 under foot 12 may be further defined by one or more inwardly extending notches 50 included in the periphery of bladder 24 of boot 10. Each notch 50 may be included in both cover 20 and liner 22, and may generally extend along a bladder seal 34, with an upper seam portion 52, and a lower seam portion 54. The upper seam portion 52 may be the lower end portion of rear seam 44, while the lower seam portion may be formed independently of rear seam 44.

Independently formed lower seal portion 54 may function to create what may be referred to as an open-looped heel for bladder 24. Independently formed lower seal portion 54 may cause bladder 24 to fold over below rear seam 44, without being closed by seam 44. The open-loop heel feature is not clearly visible in FIG. 3. The inclusion of notches 50 as part of the open-looped heel may allow bladder 24 to further expand outwardly immediately below heel 18 of foot 12, forming gas-filled auxiliary lobes 56. Such auxiliary lobes 56 may augment the pressure-increasing volume of sole portion 28 of bladder 24.

Toe seal 38 may similarly be formed independently of front seam 42, so as to form an open-looped toe 58 for boot 10. Open-looped toe 58 may be similar to the open-looped heel of boot 10, in that a loop may be formed by a portion of bladder 24 that is folded over below front seam 42, as seen in FIG. 3. Both an open-looped heel and an open-looped toe 58 may provide some ventilation of some portions of boot 10.

A number of the features discussed above and illustrated in FIG. 3 may also serve as visual reference indicating the proper placement of the lower extremity into boot 10. As the lower extremity is placed into boot 10 prior to boot inflation, such placement may be challenging. A user may be assisted in proper placement by aligning their heel 18 with notch 50, and/or by placing the arch of foot 12 over the structural interconnection 46, as discussed below with respect to FIG. 5. If foot 12 is properly positioned before inflation of bladder 24, an inflated cushion in sole portion 28 may form properly under foot 12 when bladder 24 is inflated.

Before leaving discussion of FIG. 3, it may be noted that boot 10 may include one or more pockets 60 each sized, shaped, and positioned to accommodate a thermal treatment device 62. Pocket 60 may be included on or attached to liner 22 in any position of boot 10. Pocket 60 may facilitate the placement of a thermal treatment device 62, such as an ice pack or heat pack, adjacent to an injured area. Thermal treatment device 62 may be sandwiched between bladder 24 and at least a portion of lower leg 14, ankle 19 or foot 12, that may be inserted into boot 10, when bladder 24 is inflated.

Referring briefly to FIG. 4, it may be appreciated that top seal 36 may define an opening, through which portions of the lower extremity, including leg 14, may be inserted into boot 10. As illustrated in FIG. 4, boot 10 may completely circumscribe the portions of the lower extremity encased within boot 10. Alternative embodiments may leave sides, or parts of the encased lower extremity exposed. For example, alternative embodiments may be configured to expose the toes or the heel when the lower extremity is placed within boot 10 and bladder 24 is inflated.

FIG. 5 more clearly illustrates the orientation of foot 12 within boot 10. Heel 18 of foot 12 may be relatively near to notches 50, and toes 16 of foot 12 may be relatively adjacent to liner 22 on the portion of the boot distal from notches 50. The sole of foot 12, indicated generally at 66, may be aligned approximately with a right sided structural interconnection 46.

When foot 12 is positioned within boot 10 as shown in FIG. 5, sole bladder portion 28 may be of substantial thickness. Platform 48 therefore may be spaced a significant distance above the lowermost portion of cover 20 within sole bladder portion 28. Auxiliary lobes 56 may function to augment sole portion 28. Passageways 68 may remain open between structural interconnection 46 and bladder seal 34 so that fluid within bladder 24 may pass easily from sole bladder portion 28 into leg bladder portion 26, and then back into sole bladder portion 28.

Similar aspects of boot 10 are illustrated in FIG. 6. Front seam 42 and rear seam 44 (not visible here) may divide leg bladder portion 26 to form a pair of opposing leg bladder chambers **26*a* and 26*b*, which may be fluidically interconnected to sole bladder portion 28 via passageways 68. The interconnection between leg bladder chambers 26*a* and 26*b* and sole bladder portion 28 may be better appreciated referring collectively to FIGS. 3, 5, and 6. The interconnection may be such that the inflatable interior of bladder 24, encompassed by cover 20 and liner 22, may be relatively unobstructed. Structural interconnections 46 preferably may be the only obstructions within the interior of bladder 24**.

This extensive interconnectiveness between relative proportions of leg bladder portion 26, sole bladder portion 28, structural interconnections 46, and, passageways 68, may be of such significance that any increase in pressure within any portion of bladder 24 acts substantially immediately on any other portion of bladder 24. The pressure within bladder 24 is indicated visually within FIGS. 1 through 6 by the bulging of cover 20, and the fact that liner 22, pocket 60, and thermal treatment device 62 are each pressed against foot 12 and lower leg 14.

Figure 8:
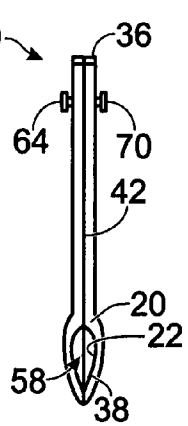
FIG. 8 is a frontal view of the boot shown in FIG. 7.
Figure 7:
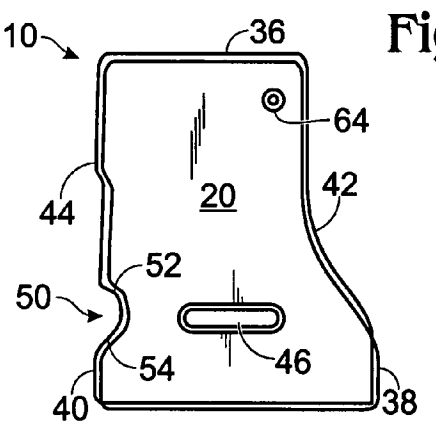
FIG. 7 is a plan view of the right side of the boot shown in FIG. 3, shown without an inserted lower extremity and uninflated.

Unlike FIGS. 1 through 6 discussed above, FIGS. 7 and 8 illustrate a boot 10 without an inserted human lower extremity. FIG. 7 shows boot 10 in an uninflated, flattened condition. Such a condition may be suitable for storage. Several elements of boot 10 discussed above are identified in FIG. 7, including structural interconnection 46, notches 50, and intake valve 64. FIG. 8 shows the flattened boot 10 of FIG. 7, with open-looped toe 58 shown slightly opened for clarity.

Figure 9:
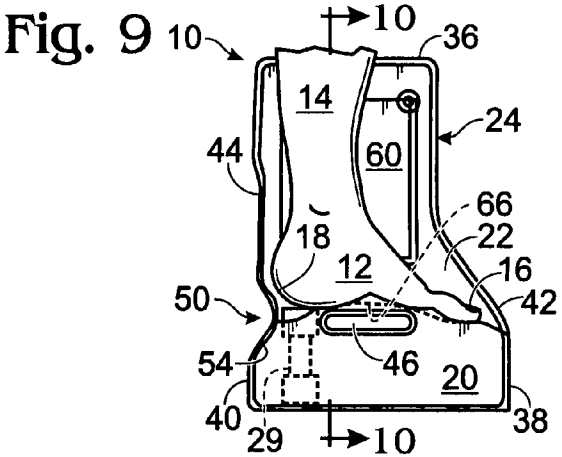
FIG. 9 is a cross-sectional view of the boot of FIG. 3 with an inserted lower extremity and partially inflated.

FIG. 9 illustrates foot 12 and lower leg 14 inserted into a mostly uninflated boot 10. Toes 16 may be positioned relatively close to front seam 42 and heel 18 of foot 12 may be positioned relatively close to notches 50. Sole 66 of foot 12 may be aligned approximately with structural interconnection 46. Thus, it may be appreciated that foot 12 is positioned approximately as shown in FIG. 5, with respect to each of these elements of boot 10. In comparison of FIG. 9 to FIG. 5, the primary difference may be that in FIG. 9 bladder 24 hangs uninflated below sole 66 of foot 12, while in FIG. 3 bladder 24 is filled with air or other fluid so that cover 20 is forced into a more rounded configuration, encircling foot 12.

Figure 10:
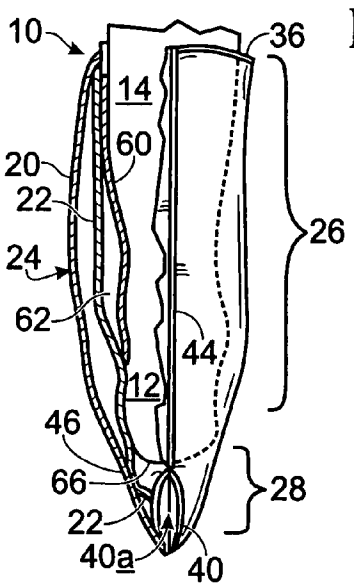
FIG. 10 is a cut-away rear view of the boot shown in FIG. 4, cut-away generally along line 10-10 of FIG. 4.

FIG. 10 also illustrates boot 10 in a mostly uninflated state. In such an uninflated state liner 22 and thermal treatment device 62, within leg bladder portion 26, may press slightly against lower leg 14, and liner 22 within sole bladder portion 28 may hang below sole 66 of foot 12. Boot 10 may include an open-looped heel caused by independently formed heel seal 40, as indicated generally at **40*a*. The portion of liner 22 that hangs below sole 66 may be the portion that forms a foot-supporting contour for sole portion 28 when bladder 24 is inflated, as seen best in FIG. 11**.

Figure 11:
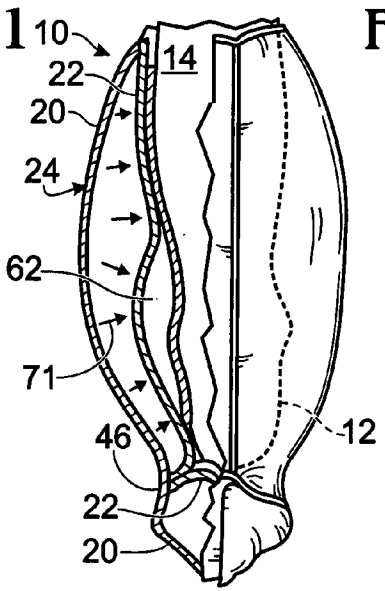
FIG. 11 is a cut-away rear view of the boot shown in FIG. 10 with the boot inflated and in a neutral condition.

FIG. 11 illustrates boot 10 in an inflated state, and further depicts the interactions between structural interconnection 46, cover 20, and liner 22. As bladder 24 is inflated, liner 22 within sole portion 28 may fold up around structural interconnection 46, forming a foot-conforming contour of boot 10. The fluid within bladder 24 may press relatively evenly on foot 12 and lower leg 14, as indicated by the pressure-indicating arrows 71.

Figure 12:
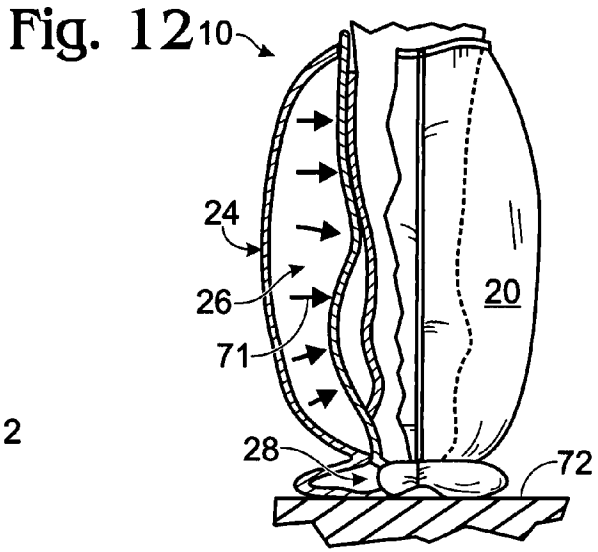
FIG. 12 is a cut-away rear view of the boot shown in FIG. 11, with the boot in its pressurized condition.

Referring now to FIG. 12, boot 10 is shown in a compressed condition, as when bladder 24 is inflated to within a therapeutic range, and an applied force has pressed bladder 24 against surface 72. In such a compressed, or pressurized condition, the volume of sole bladder portion 28 may be substantially diminished increasing the fluid pressure within sole bladder portion 28.

As discussed above, a pressure increase within one portion of bladder 24 may be communicated to the remaining portions of bladder 24. Thus, a pressure increase within sole bladder portion 28 may cause a pressure increase within leg bladder portion 26. This pressure increase is indicated by the increased size of pressure-indicating arrows 71 in FIG. 12 as compared to those in FIG. 11. It also may be noted that cover 20 of boot 10 may be forced into a much more rounded configuration in FIG. 12, when compared to FIG. 11.

FIGS. 13 through 17 illustrate an alternative embodiment of the inflatable boot of the present disclosure. Many of the elements illustrated in boot 110 are substantially similar to elements discussed above with respect to boot 10. Accordingly, rather than reintroducing these elements, they are referred to below, and identified in FIGS. 13 through 17 with the reference characters used in prior Figs., each preceded by a "1."

Figure 14:
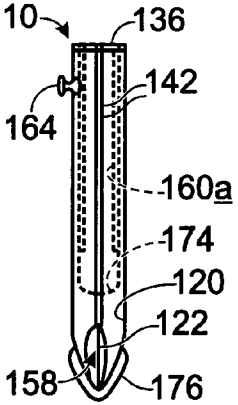
FIG. 14 is a frontal view of the boot shown in FIG. 13.
Figure 13:
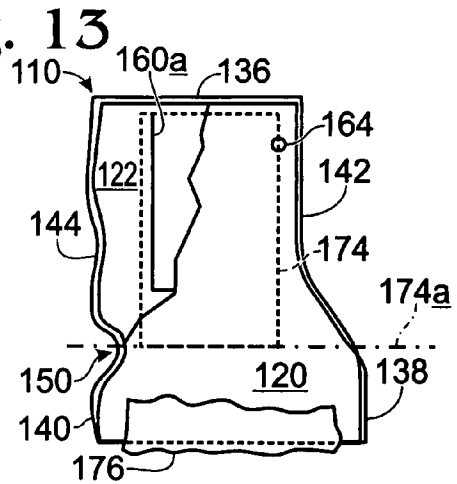
FIG. 13 is a cut-away view of the right side of an inflatable boot with an internal sling according to the present disclosure.

FIGS. 13 through 17 illustrate a boot 110 which includes a support sling 174. Boot 110 may include a sling 174 for supporting the encased lower extremity. Sling 174 may be made of any flexible sheet material, such as, nylon fabric, webbing, polyurethane, canvas, rubber, etc. Sling 174 may be undersized relative to cover 120 and liner 122 so that sling 174 hangs substantially above cover 120 within sole bladder portion 128, as shown in FIGS. 13 and 14 by fold line 174*a* of sling 174.

Because of this size difference between sling 174 and liner 122 it may be difficult to attach sling 174 to liner 122. In some embodiments, sling 174 may be attached to liner 122 after front and rear seams 142 and 144 are formed, and may be adhered to liner 122 using a variety of adhesives, sealants, or fasteners. Portions of sling 174 may be attached to liner 122 in combination with pocket 160.

Some embodiments of boot 110, or of boot 10, may also include a tread 176, illustrated in FIGS. 13 through 16. Tread 176 may be placed on the bottom of the boot 110 and may increase the wear resistance of an inflatable boot. This tread 176 may made from of rubber, plastic, resin, neoprene, or any other suitable flexible wear resistant material.

Figure 15:
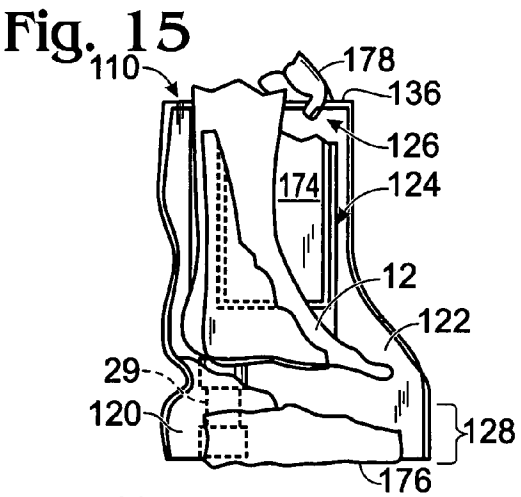
FIG. 15 is a cut-away view of the boot shown in FIG. 13 with a lower extremity inserted.

FIG. 15 also illustrates a sling 174 around a portion of a foot 12 inserted into boot 110 while boot 110 is in its mostly uninflated condition. A wall portion 126 of boot 110 may be held by a user hand 178, while the foot is being inserted into the sling, and/or when the boot 110 is inflated. Upon insertion into bladder 124, foot 12 may contact sling 174 substantially before contacting sole portion 128. Thus, sling 174 may provide a positive-positioning element for boot 110, operating as a platform-defining element suspended within bladder 124, located inwardly of liner 122. Foot 12 may therefore be supported by a cushion formed by sole portion 128 of bladder 124 when bladder 124 is inflated, the cushion being defined between sling 174 and cover 120.

Figure 17:
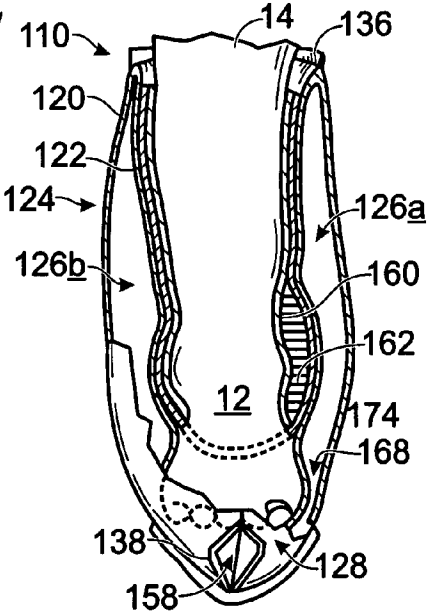
FIG. 17 is a cut-away frontal view of the boot shown in FIG. 13, illustrating a sling portion with a lower extremity inserted.
Figure 16:
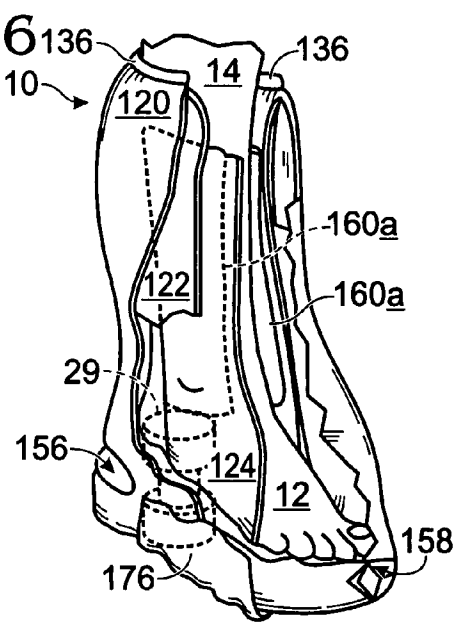
FIG. 16 is a cut-away perspective view of the boot shown in FIG. 13, showing the boot partially inflated and with a lower extremity inserted.

FIGS. 16 and 17 show boot 110 with foot 12 and lower leg 14 inserted, and with boot 110 partially inflated. As best seen in FIG. 17, when boot 110 is partially inflated sling 174 may be substantially adjacent to liner 122. A pocket 160 containing a thermal treatment device may also be included in boot 110. The pocket 160 may be formed out of portion of sling 174, or alternatively may be independent of sling 174.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Where the disclosure or subsequently filed claims recite "a" or "a first" element or the equivalent thereof, it should be within the scope of the present inventions that such disclosure or claims may be understood to include incorporation of one or more such elements, neither requiring nor excluding two or more such elements.

Applicant reserves the right to submit claims directed to certain combinations and subcombinations that are directed to one of the disclosed inventions and are believed to be novel and non-obvious. Inventions embodied in other combinations and subcombinations of features, functions, elements and/or properties may be claimed through amendment of those claims or presentation of new claims in that or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. An inflatable boot, comprising:

an inflatable bladder for encasing a portion of a lower extremity, the bladder being formed by a liner and a cover, the bladder including at least one wall portion and a sole portion, wherein the bladder is adapted to be inflated with air to a bladder air pressure;

at least one passageway fluidically interconnecting the at least one wall portion and the sole portion;

a pump adapted to move external air into the sole portion of the inflatable bladder; and a bladder-pressure-triggered pressure relief valve disposed in fluid communication with the bladder and integrally coupled to the bladder cover, wherein the pressure relief valve is adapted to limit the air pressure within the bladder to less than or equal to a predetermined maximum therapeutic pressure by discharging air from within the bladder when the bladder air pressure exceeds a predetermined trigger pressure, additionally including an inlet valve disposed distally from the pump and through which air may be selectively pumped into the bladder, wherein the inlet valve is disposed on the sole portion.

2. The inflatable boot of claim 1, wherein the lower extremity includes portions of a lower leg, ankle, and foot.

3. The inflatable boot of claim 1, wherein the pump is adapted to draw external air into the inflatable bladder by ambulatory motion.

4. The inflatable boot of claim 1, wherein the pump is a compression pump.

5. The inflatable boot of claim 1, wherein the pump is at least partially disposed within the sole portion of the bladder.

6. The inflatable boot of claim 1, wherein the pump is disposed at least partially beneath a heel region of the encased lower extremity.

7. The inflatable boot of claim 1, wherein the predetermined maximum therapeutic pressure is at least about 25 mm Hg and no more than about 125 mm Hg.

8. The inflatable boot of claim 1, wherein the predetermined maximum therapeutic pressure is at least about 50 mm Hg and no more than about 75 mm Hg.

9. The inflatable boot of claim 1, additionally including a tread on at least a portion of the sole portion.

10. The inflatable boot of claim 1, wherein the predetermined maximum therapeutic pressure is between about 20 mm Hg and about 50 mm Hg.

* * * * *